US006542613B1

(12) United States Patent
Rieber

(10) Patent No.: US 6,542,613 B1
(45) Date of Patent: Apr. 1, 2003

(54) ELECTRONIC SOUND GENERATOR ATTACHMENT FOR CHILDREN'S SLIDES

(75) Inventor: Frederick M. Rieber, Alum Bank, PA (US)

(73) Assignee: Hedstrom Corporation, Bedford, PA (US)

( * ) Notice: Subject to any disclaimer, the term of this patent is extended or adjusted under 35 U.S.C. 154(b) by 0 days.

(21) Appl. No.: 09/193,038

(22) Filed: Nov. 16, 1998

(51) Int. Cl.[7] ..... H04B 1/00
(52) U.S. Cl. ..... 381/124; 369/31; 472/116
(58) Field of Search ..... 472/116–117; 381/61, 381/124, 82, 85, 79, 77; 701/94; 704/270, 272, 278, 271; 369/31; 446/298

(56) References Cited

U.S. PATENT DOCUMENTS 4,756,454 A * 7/1988 Villanueva ..... 224/30
4,865,550 A * 9/1989 Chu ..... 434/267
4,876,678 A * 10/1989 Koike et al. ..... 369/31
5,054,012 A * 10/1991 Koike et al. ..... 369/31
5,241,427 A * 8/1993 Lin ..... 360/1
5,382,188 A * 1/1995 Tomellini ..... 446/142
5,496,232 A * 3/1996 Morris et al. ..... 482/35
5,784,473 A * 7/1998 Ferren ..... 381/86
5,903,869 A * 5/1999 Jacobson et al. ..... 704/272
5,986,540 A * 11/1999 Nakagaki et al. ..... 340/384
6,017,260 A * 1/2000 Dolan ..... 446/298

* cited by examiner

*Primary Examiner*—Duc Nguyen
*Assistant Examiner*—Lun-See Lao
(74) *Attorney, Agent, or Firm*—Cesari & McKenna, LLP

(57) ABSTRACT

A sound generating attachment for a slide of the type having an inclined sliding surface, a pair of raised sidewalls at opposite sides of said surface and a handrail extending up from one of the sidewalls. The attachment includes a weather-resistant housing having a top wall, a bottom wall and an end wall and a clamp for releasably attaching the housing to a slide sidewall. An electronic sound generator in the housing emits a plurality of different sound message a rotatable and depressable control knob projecting from the housing top wall is turned and pressed by a child using the slide.

3 Claims, 2 Drawing Sheets

ELECTRONIC SOUND GENERATOR ATTACHMENT FOR CHILDREN'S SLIDES

This invention relates to children's slides. It relates more particularly to a slide attachment in the nature of an electronic sound generator which can be activated by a child using the slide.

BACKGROUND OF THE INVENTION

As is well known, a children's slide comprises an elongated sliding surface having one end which is supported well above the ground and a second end located close to the ground. A child may climb to the elevated end and slide down the sliding surface in a s sitting, prone or supine position, exiting the slide at ground level. Frequently, such slides are incorporated into children's gym sets, swing sets and the like.

Over time, some children become bored because of the repetitiveness of this play activity. Therefore, it would be highly desirable to introduce an element of variety into the act of sliding down a children's slide in order to maintain the child's interest.

SUMMARY OF THE INVENTION

Accordingly, it is an object of the present invention to provide a sound generator attachment for a children's slide which can be activated by a child using a slide to maintain the child's level of interest during repeated uses of the slide.

Another object of the invention is to provide such an attachment which can be controlled by the child to produce a wide variety of different sounds as the child slides down the slide.

A further object of the invention is to provide a sound generator attachment such as this which is easy to operate even by small children.

A further object of the invention is to provide a sound generator attachment for a children's slide which is completely self-contained and weatherproof.

Another object of the invention is to provide a battery-operated sound generator of this type which can be retrofit to many existing children's slides.

Other objects will, in part, be obvious and will, in part, appear hereinafter.

The invention accordingly comprises the features of construction, combination of elements and arrangement of parts which will be exemplified in the following detailed description, and the scope of the invention will be indicated in the claims.

Briefly, the electronic sound generator attachment comprises a rigid, weather-resistant housing which can be releasably attached to the hand rail at the top of a typical children's slide. The housing is shaped to rest on a slide sidewall away from the sliding surface so that it does not interfere with a child using the slide. Yet, the attachment is readily accessible to that child so that he/she can easily activate the device at the beginning of each slide run.

A large control knob projects from the top of the housing. This knob may be pushed by a child to activate an electronic sound generator or voice box within the housing so that a voice message and/or sound emanates from the housing. The knob can also be turned between a plurality of set positions to select between a number of different message and/or sounds stored by the electronic voice box. Thus, by rotating the control knob to a selected angular position and depressing the knob, the attachment can be caused to emit a selected voice message and/or sound as the child launches him/herself down the slide.

As will be seen presently, the sound generator attachment is relatively simple to make and to assemble and the electronic components of the device are well protected by the housing from rain, wind and weather. Therefore, the sound generator attachment should have a relatively long useful life.

BRIEF DESCRIPTION OF THE DRAWING

For a fuller understanding of the nature and objects of the invention, reference should be had to the following detailed description taken in connection with the accompanying drawing, in which.

DETAILED DESCRIPTION OF THE PREFERRED EMBODIMENT

Figure 1:
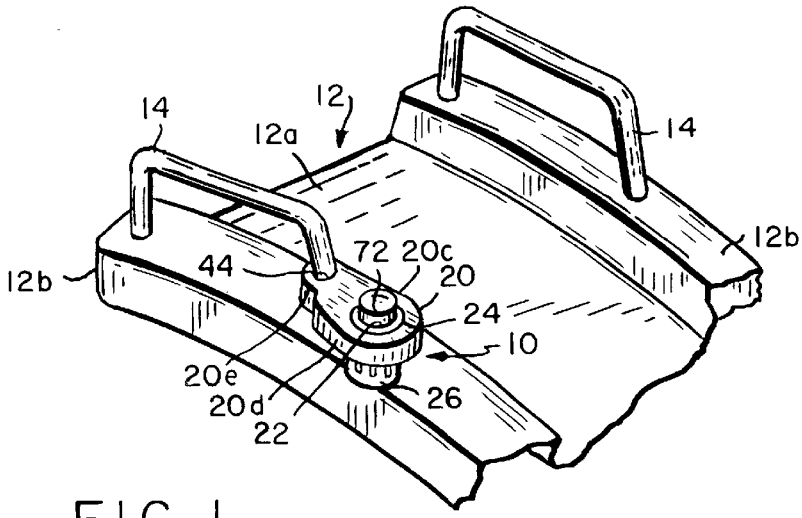
FIG. 1 is a fragmentary perspective view of a children's slide incorporating the electronic sound generator attachment of the invention.

FIG. 1 shows the subject sound generator attachment generally at 10 installed on a typical children's slide 12 having a sliding surface 12*a*, bounded at its opposite sides by raised sidewalls 12*b* outfitted with hand rails 14 which project up from the sidewalls 12*b* at the top of the slide. As shown in FIG. 1, the sound generator attachment 10 is releasably clamped to the leg of one of the hand rails 14 so that the device rests horizontally on the top of the corresponding sidewall 12*b* away from the sliding surface 12*a* of the slide.

Figure 2:
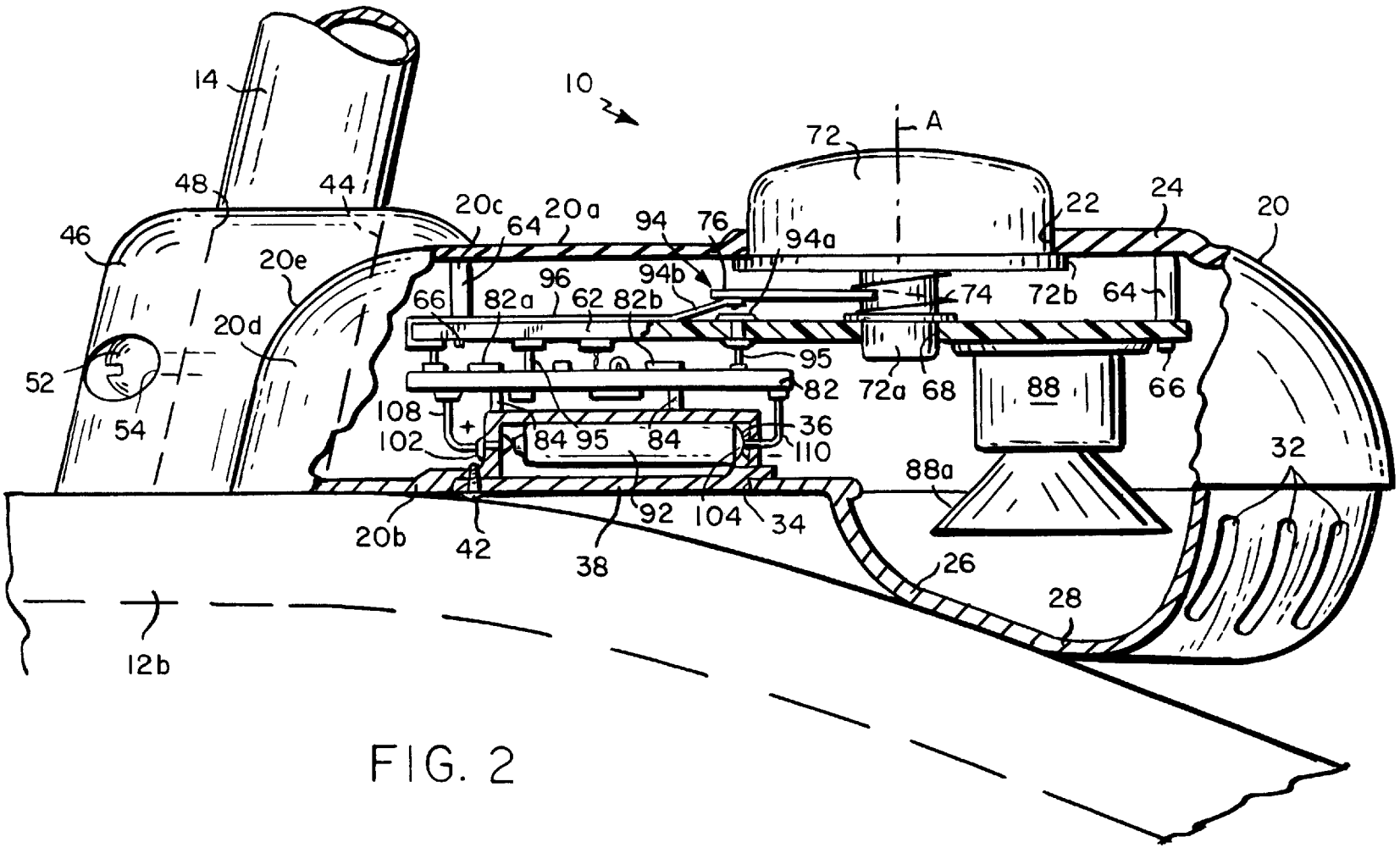
FIG. 2 is a side elevational view on a much larger scale with parts broken away showing the internal components of the FIG. 1 sound generator in greater detail.

Referring now to FIGS. 1 and 2, attachment 10 comprises an elongated, rigid, weatherproof resistant plastic housing 20 having a top wall 20*a*, a bottom wall 20*b*, a relatively straight sidewall 20*c* and a curved sidewall 20*d*. Top wall 20*a* is provided with a large circular opening 22 which is surrounded by a raised rib 24. The bottom wall 20*b* is formed with a depending cup-like protuberance 26 adjacent to one end of the bottom wall. That protuberance defines a well 28 inside the housing. Vertical slots 32 are formed in the sidewall of protuberance 26 all around the protuberance.

Housing bottom wall 20*b* also contains a generally rectangular opening 34 which provides access to a recessed battery compartment 36 formed in bottom wall 20*b*. That opening 34 is closed by a removable cover 38 which may be secured in the closed position by a fastener 42 as is well known from conventional, battery-operated toys, games, etc.

If desired, the housing bottom wall 20*b* may be separable from the remainder of the housing to provide access to the interior of the housing in order to assemble and/or repair various internal components of the attachment 10.

Still referring to FIGS. 1 and 2, the end of housing 20 remote from the protuberance 26 is provided with an end wall 20*e* which is inwardly curved semicylindrically in order to wrap part way around a leg of hand rail 14 (FIG. 1). This allows attachment 10 to be positioned on the underlying sidewall 12*b* of the slide 12 as shown in FIG. 1 so that the housing end wall 20*e* butts up against the leg of the hand rail 14. The recess 44 is oriented and the protuberance 26 is dimensioned so that when the attachment is so positioned on the slide wall 12*b*, the housing top wall 20*a* is more or less horizontal as shown in FIG. 2.

The housing 20 may be releasably attached to the hand rail 14 by a bracket 46 having a semi-cylindrical recess 48 which is a mirror-image of recess 44 thereby allowing the bracket to wrap around the hand rail and mate with the housing endwall 20*e*. The bracket may be releasably secured to housing 20 by a pair of fasteners 52 which extend through recessed openings 54 in the retainer on opposite sides of the hand rail leg and are turned down into threaded holes in the housing endwall 20*e*.

Referring to FIG. 2 of the drawing, housing 20 contains a printed circuit board 62 which is spaced below housing top wall 20*a* by stand-offs 64 to which it is secured by threaded fasteners 66. The circuit board contains a small circular hole 68 which is centered below the opening 22 in the housing top wall 20*a*. Hole 68 is designed to receive the stem 72*a* of a large control knob 72 which projects up through the opening 22 in the housing top wall. A coil spring 74 encircles stem 72*a* and is compressed between the underside of the control knob 72 and circuit board 62 thereby urging the control button along an axis A away from the circuit board. A peripheral flange 72*b* at the lower edge of knob 72 limits the upward motion of the control knob.

As best seen in FIG. 2, an arm 76 extends radially out from the control knob stem 72*a* between the underside of the control knob and printed circuit board 62. When the control knob is in its stable extended or raised position shown in FIG. 2, arm 76 is spaced away from printed circuit board 62. On the other hand, when control knob 72 is depressed in opposition to the bias of spring 74, the arm 76 is located closer to circuit board 62. In addition to its ability to be moved vertically along axis A, the control knob 72 can be rotated about that axis A so that its arm 76 can be rotated to various selected positions about the axis A. If desired, these various angular positions can be predetermined by providing a circular array of interfitting radial ribs on the top of the button flange 72*b* and on the underside of housing top wall 20*a* around opening 22 therein (not shown).

Also contained in housing 20 is a control circuit 82 in the form of a printed circuit board supported on standoffs 84 by the top wall of the battery receptacle 36 and a small audio speaker 88 mounted to the underside of the circuit board 62 such that the speaker cone 88*a* projects down into the well 28 defined by the protuberance 26. A suitable speaker is a 2½ inch speaker adapted for outdoor applications.

The various electrical components of the sound generator attachment are energized by current from batteries 92 in the battery receptacle 36 which may be accessed by removing door 38 as described above. Typically, attachment 10 utilizes three C-type batteries.

Figure 3:
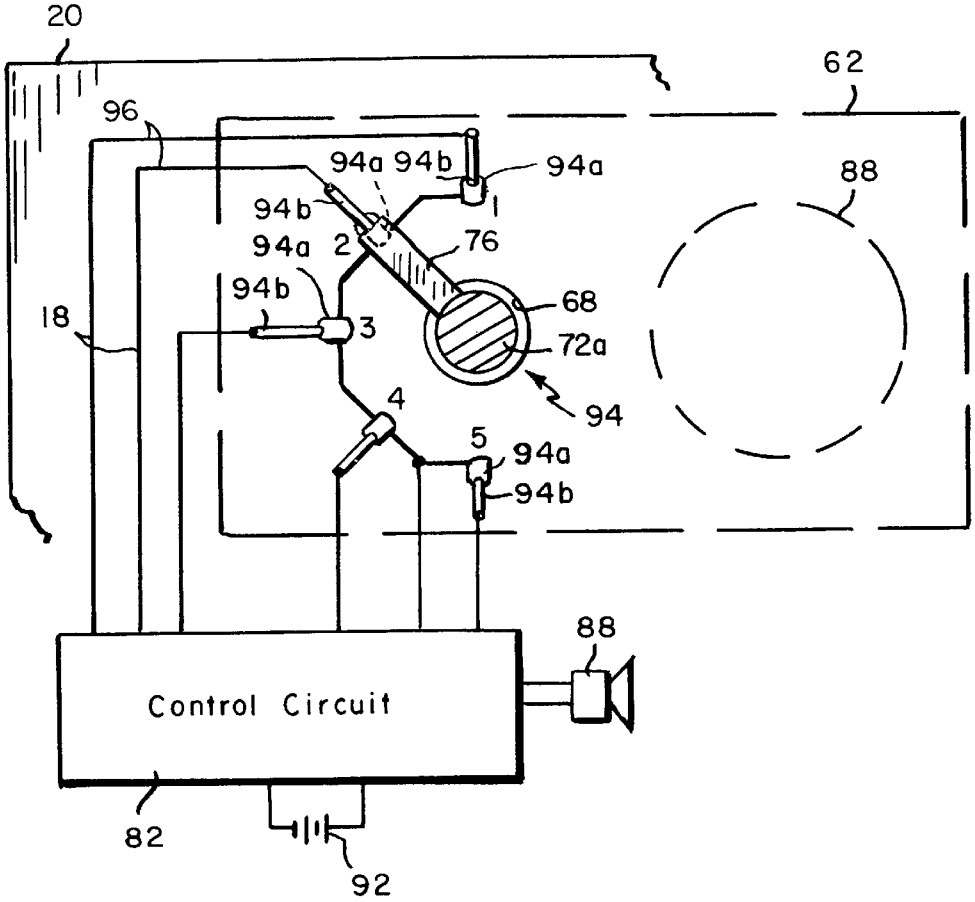
FIG. 3 is a diagrammatic view illustrating the operation of the sound generator.

Referring now to FIGS. 2 and 3, the printed circuit board 62 carries a plurality of switches 94 disposed in a circle about the hole 68 in the circuit board. In the illustrated attachment, there are five switches 94 located at switch positions bearing the numbers 1 to 5. Each switch comprises a stationary contact 94*a* connected by a common conductor 95 to control circuit 82 and a leaf spring-type moving contact 94*b* having a free end overlying the contact 94*a* and a fixed end connected by a conductor 96 to control circuit 82. Normally, the free end of the contact 94*b* of each switch 94 is spaced above the corresponding fixed contact 94*a*. However, when the control knob 72 is turned to position its arm 76 above that switch 94 and the knob 72 is depressed, the arm 76 will push contact 94*b* into engagement with the underlying contact 94*a* thereby completing a circuit between the two conductors 95 and 96 associated with that activated switch 94.

Control circuit 82 receives power from batteries 92 via positive and negative contacts 102 and 104, respectively, in the battery receptacle 36, those contacts being connected to control circuit 82 by electrical conductors 108 and 110, respectively.

Control circuit 82 is basically a printed circuit card or board of a known type incorporated into talking toys. In other words, it contains the necessary memory chip 82*a*, D/A converter 82*b* and the other supporting electrical components to deliver audio signals to the speaker 88 so that the speaker emits voice messages and/or sounds corresponding to the data stored by the chip. In the present attachment 10, control circuit 82 can produce five different sounds or messages depending upon which one of the switches 94 is closed by the control knob 72. For example, when the control button 72 is turned to switch position No. 1 and depressed to close the associated switch 94, control circuit 82 may deliver audio signals to speaker 88 causing the speaker to sound the message "3-2-1 . . . Blast Off" accompanied by the roar of a rocket engine which fades over time. On the other hand, when the control knob is turned to switch position No. 2 and depressed, the sound-generator attachment may sound "On Your Mark . . . Get Set . . . Go . . . " accompanied by a cheering noise which fades over time. Activating the attachment at switch position No. 3 may produce a cartoon-like whistle with ascending frequency followed by a "Boing" sound. Other possibilities are the sound of race cars approaching, passing and departing, a jet plane doing a slow fly-by, police/fire sirens approaching, passing and fading away. The illustrated attachment 10 produces voice/sound messages at a frequency of 22 kHz for about 6 seconds at a decibel rating of about 115 dB.

The sound-generating attachment described herein should prove to be a very marketable toy item. It adds to the enjoyment of children using a slide. Also, it is a relatively easy and inexpensive device to make in quantity and should operate reliably for a prolonged period, even when exposed to the weather. In this connection, it should be noted that normally the control knob 72 is in its raised position illustrated in FIG. 2. Therefore, rain or moisture is prevented from entering the housing 20 through the opening 22 because the knob lip 72*d* presses up against the underside of the housing top wall 20*a* providing a sliding seal all around the button opening 22. However, if rainwater should enter the housing 20, it would drop down into the housing well 28 and drain therefrom through the slots 32.

It will thus be seen that the objects set forth above, among those made apparent from the preceding description, are efficiently attained and, since certain changes may be made in the above description, it is intended that all matter contained in the above description or shown in the accompanying drawing shall be interpreted as illustrative and not in a limiting sense.

It is also to be understood that the following claims are intended to cover all of the generic and specific features of the invention described herein.

What is claimed is:

1. A sound generating attachment for a slide of the type having an inclined sliding surface and a pair of raised sidewalls at opposite sides of said surface, said attachment comprising a weather-resistant housing having a top wall, a bottom wall and an end wall, said bottom wall including an external protuberance;

an electronic sound generator in the housing for emitting a plurality of different selectable sound messages;

selection means protruding from said top wall for selecting between the sound messages emitted by the sound generator so that the sound generator emits the selected message to the exclusion of the other selectable messages;

attaching means for releasably attaching the housing to a slide sidewall, said attaching means including a hand rail extending up from one of said sidewalls, a recess in said end wall for receiving an upstanding portion of said hand rail, a bracket for engaging said upstanding hand rail portion opposite said end wall, and fastening means fastening the bracket to said end wall so as to clamp the attachment to the handrail, said protuberance being dimensioned to rest on said sidewall when the attachment is clamped to the handrail so that the housing top wall lies in a substantially horizontal plane allowing easy access to the selection means by a child sitting on the sliding surface.

2. The attachment defined in claim 1 wherein the sound generator includes a sound chip for producing, in response to a plurality of selection signals, a corresponding plurality of digital signal streams representing a plurality of sound messages stored by the chip;

a digital-to-analog converter for converting the digital signals to audio signals;

a speaker responsive to the audio signals for sounding messages;

a power source for energizing the sound generator, and wherein the selection means applies selection signals to the chip to select between the messages to be sounded by the speaker.

3. The attachment defined in claim 2 wherein the protuberance defines a well with slotted walls, and the speaker projects into the well.

* * * * *